US006634462B2

(12) United States Patent
Byeong-Ho

(10) Patent No.: US 6,634,462 B2
(45) Date of Patent: Oct. 21, 2003

(54) FREE LINK SYSTEM FOR PRECISE CONTROL

(75) Inventor: Choi Byeong-Ho, Ulsan (KR)

(73) Assignee: Hyundai Motor Company, Seoul (KR)

( * ) Notice: Subject to any disclaimer, the term of this patent is extended or adjusted under 35 U.S.C. 154(b) by 101 days.

(21) Appl. No.: 09/953,492

(22) Filed: Sep. 14, 2001

(65) Prior Publication Data

US 2002/0060137 A1 May 23, 2002

(30) Foreign Application Priority Data

Sep. 14, 2000 (KR) ..... 2000-53928

(51) Int. Cl.[7] ..... B66F 7/16; B66F 7/22

(52) U.S. Cl. ..... 187/269; 187/211; 187/213; 187/215; 187/272; 254/93 R; 254/89 H

(58) Field of Search ..... 187/203, 210, 187/211, 213, 215, 250, 269, 272, 274, 275; 254/93 R, 89 H

(56) References Cited

U.S. PATENT DOCUMENTS 2,471,901 A * 5/1949 Ross ..... 254/89 H
4,149,469 A * 4/1979 Bigler ..... 254/89 H
4,403,680 A * 9/1983 Hillesheimer ..... 187/269
4,886,145 A * 12/1989 Iwahashi ..... 254/89 H
5,727,655 A * 3/1998 Pitman ..... 187/211

FOREIGN PATENT DOCUMENTS

DE 3824563 A1 * 2/1990 ..... 254/93 R
DE 4326438 A1 * 3/1994 ..... 254/93 R
JP 02008200 A * 1/1990 ..... 254/93 R
JP 11-246190 9/1999

* cited by examiner

*Primary Examiner*—Eileen D. Lillis
*Assistant Examiner*—Thuy V. Tran
(74) *Attorney, Agent, or Firm*—Christie, Parker & Hale, LLP

(57) ABSTRACT

A free link system including a drive assembly mounted along an imaginary longitudinal center line of a rectangular base, the drive assembly including two identical units provided on opposing ends of the base; a main platform that is raised and lowered by operation of the drive assembly; and a guide frame mounted to the base extending perpendicularly to the same, the guide frame being provided on one long end of the base and acting to guide the movement of the main platform.

5 Claims, 3 Drawing Sheets

FREE LINK SYSTEM FOR PRECISE CONTROL

CROSS-REFERENCE TO RELATED APPLICATION

This application claims priority of Korea patent Application No. 10-2000-0053928, filed on Sep. 14, 2000.

BACKGROUND OF THE INVENTION (a) Field of the Invention

The present invention relates to a free link system for precise control. More particularly, the present invention relates to a free link system for precise control in which by uniformly guiding the motion of links through the use of a link guide system that ascends and descends when raising or lowering a light or heavy object, movement of the object placed on a platform is prevented such that the optimal application of a press panel automatic loading system provided in automatic conveying equipment is realized.

(b) Description of the Related Art

FIG. 1 shows a schematic view of a conventional free link system, FIG. 2 shows an end view of FIG. 1, FIG. 3 shows a view taken along line A—A of FIG. 2, and FIG. 4 shows a view taken along line B—B of FIG. 2.

A conventional free link system 2 includes a main platform 4, a base 6, a drive assembly 8, and a guide assembly 10. The main platform 4 is a rectangular plate and includes first hinge brackets 12 (for use by the guide assembly 10), which are mounted to each corner area of an inner surface of the main platform 4. Further, second hinge brackets 14 (for use by the drive assembly 8) are provided between the first hinge brackets 12.

The base 6 is rectangular and has outer dimensions that substantially correspond to outer dimensions of the main platform 4. The base 6 and the main platform 4 are provided opposing one another. The base 6 includes third and fourth hinge brackets 16 and 18, which are mounted to an inner surface of the base 6 at positions opposing the first and second hinge brackets 12 and 14, respectively.

The drive assembly 8 includes first drive links 20 having a first end connected to the fourth hinge brackets 18 of the base 6; piston links 28 having a first end connected to second ends of the first drive links 20 via drive link hinge pins 22, and a second end rotatably connected to cylinder brackets 26, the cylinder brackets 26 being connected to hydraulic power-generating cylinders 24; and second drive links 31 having a first end connected to a predetermined position of the first drive links 20 through hinge pins 30, and a second end connected to the second hinge brackets 14 of the main platform 4. The drive assembly 8 is provided substantially along an imaginary longitudinal centerline of the base 6.

The guide assembly 10 includes first free links 32 and second free links 40. The first free links 32 are provided to both sides of the drive assembly 8. First ends of first free links 32 are mounted through a hinge connection to the third hinge brackets 16 of the base 6. Second ends of the first free links 32 are mounted through hinges 34 to a predetermined location of the second free links 40. Rollers 38 are mounted to first ends of the second free links 40 and the rollers 38 are positioned in a guide slot 42 defined by a roller guide 36. Accordingly, the first ends of the second free links 40 are free to move along the roller guide 36. Second ends of the second free links 40 are mounted through a hinge connection to the first hinge brackets 12 of the main platform 4.

With the free link system 2 structured as in the above, if each piston link 28 of the drive assembly 8 is extended by the operation of the hydraulic power-generating cylinders 24, the second ends of the first drive links 20 rise such that the second drive links 31 are displaced. Accordingly, the main platform 4 ascends.

At the same time, the first ends of the second free links 40 of the guide assembly 10 move along the guide slot 42 of the roller guide 36 on the rollers 38. As a result, the second free links 40 are raised. The first free links 32 of the guide assembly 10 are also raised through the interconnection of the second free links 40 and the first free links 32 via the hinges 34, and through the pivoting action of the first free links 32 on the third hinge brackets 16. As a result of the operation of the guide assembly 10, the main platform 4 remains level as it is raised. The main platform 4 is lowered in the opposite manner in which it is raised. In the case where a left end of the main platform 4 is raised, the main platform 4 is tilted to rise with the first and second hinge brackets 12 and 14 as pivot points.

However, the free link system structured as in the above has many drawbacks as follows:

(1) When the main platform is raised or lowered, the amount of lateral motion from the reference line, which is based on the first, second, third and fourth hinge brackets, is not uniform. Accordingly, it is not possible to establish a reference starting point.

(2) Since the path of the curve of motion based on the first, second, third and fourth hinge brackets is not uniform, position variations caused by left and right movement of the object placed on the system is severe such that the system is not suitable for application to a vehicle system.

(3) In a state where a large object is placed on the system, if shock is generated by an abrupt change in position of the object, a substantial load is given to each link or pins between the links. Accordingly, damage or deformation of the links and hinge pins result.

(4) Left and right slipping of the first and second free links results in wear of the links.

(5) The guide assembly, which includes elements that slide along the roller guide, is not structured to prevent lateral leaning of the main platform, particularly in the case where there is a heavy object placed on the main platform.

(6) The system is not suitable for use in heavy load systems or systems where a reference starting point is desired.

(7) A large device results in a complicated structure. This is particularly true with increasing overall size of the free link system.

SUMMARY OF THE INVENTION

The present invention has been made in an effort to solve the above problems.

It is an object of the present invention to provide a free link system for precise control, in which by uniformly guiding the motion of links through the use of a link guide system that ascends and descends when raising or lowering a light or heavy object, movement of the object placed on a platform is prevented such that the optimal application of a press panel automatic loading system provided in automatic conveying equipment is realized.

To achieve the above object, the present invention provides a free link system comprising a drive assembly mounted along an imaginary longitudinal center line of a rectangular base, the drive assembly including two identical units provided on opposing ends of the base; a main platform that is raised and lowered by operation of the drive assembly; and a guide frame mounted to the base extending perpendicularly to the same, the guide frame being provided on one end of the base and acting to guide the movement of the main platform.

According to a feature of the present invention, each unit of the drive assembly comprises a hinge bracket mounted to the base along the imaginary longitudinal line; a piston link, a first end of which is rotatably mounted to the hinge bracket and connected to a hydraulic power-generating cylinder; an angled link having an angled portion shaped at a predetermined angle, a first end mounted to a second hinge bracket, which is fixedly mounted to the base, and a second end connected to a second end of the piston link through a hinge connector; and a support link having a first end connected to the angled portion of the angled link through a first hinge pin and a second end connected to the main platform through a second hinge pin.

According to another feature of the present invention, the main platform comprises a support bracket provided on each end of the main platform to which the support links of the drive assembly are connected; and roller assemblies mounted to corners of one end of the main platform, the roller assemblies sliding within the guide frame.

According to yet another feature of the present invention, slide grooves are formed at a predetermined length in the guide frame, and rollers of the roller assemblies are positioned within the slide grooves to enable rectilinear motion therein by rotating about their axes.

According to still yet another feature of the present invention, a side of the main platform not supported by the guide frame follows a predetermined trace as the main platform is tilted by the drive assembly.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Preferred embodiments of the present invention will now be described in detail with reference to the accompanying drawings.

Figure 1:
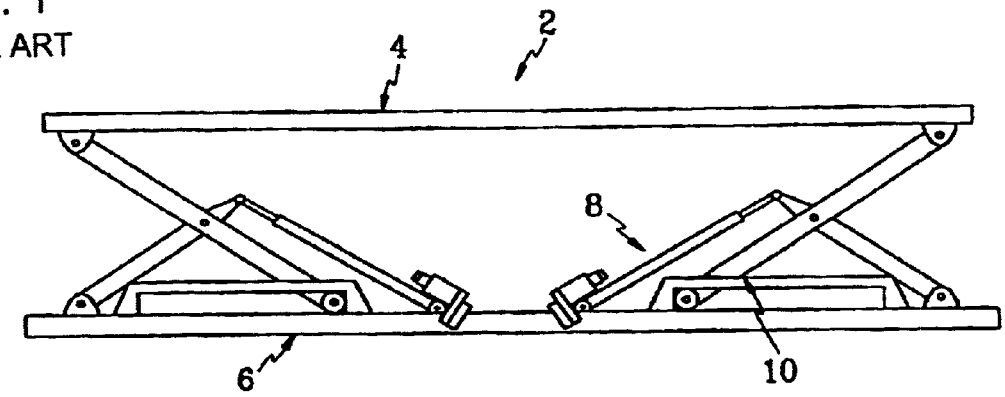
FIG. 1 PRIOR ART
FIG. 1 is a schematic side view of a conventional free link system.
Figure 2:
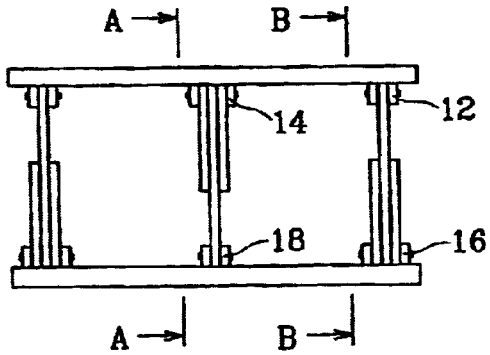
FIG. 2 PRIOR ART
FIG. 2 is an end view of the free link system shown in FIG. 1.
Figure 3:
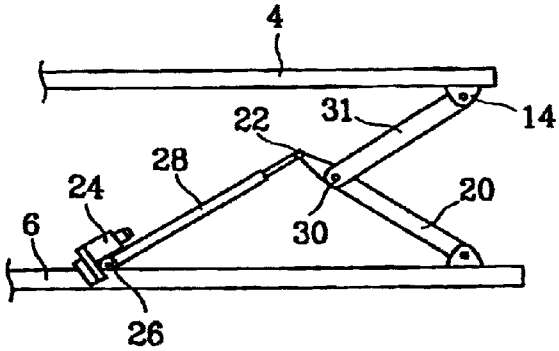
FIG. 3 PRIOR ART
FIG. 3 shows a view taken along line A—A of FIG. 2.
Figure 4:
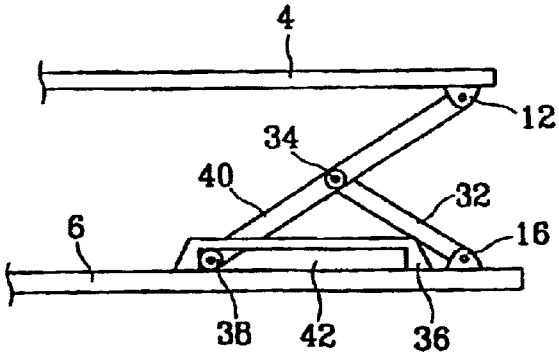
FIG. 4 PRIOR ART
FIG. 4 shows a view taken along line B—B of FIG. 2.
Figure 5:
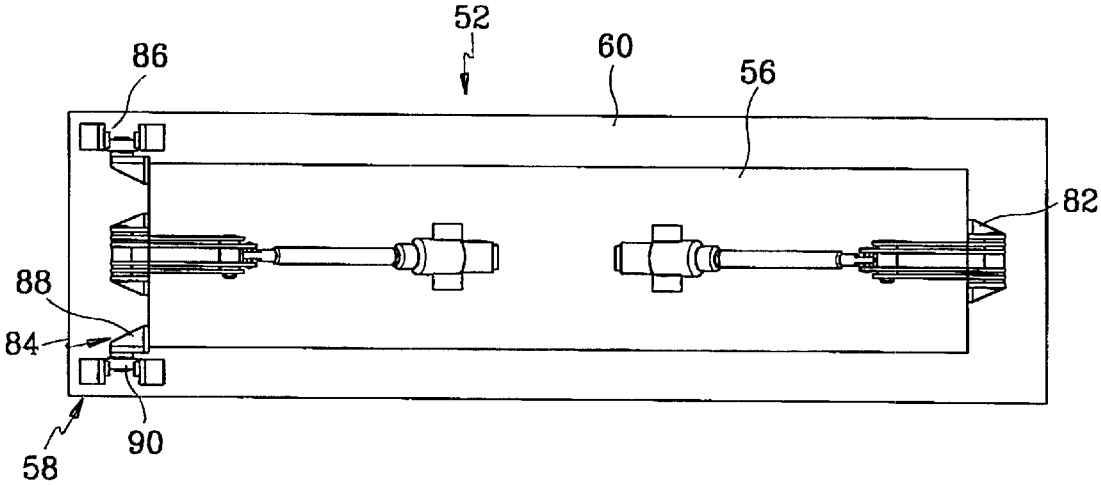
FIG. 5 is a plane view of the free link system according to a preferred embodiment of the present invention.
Figure 6:
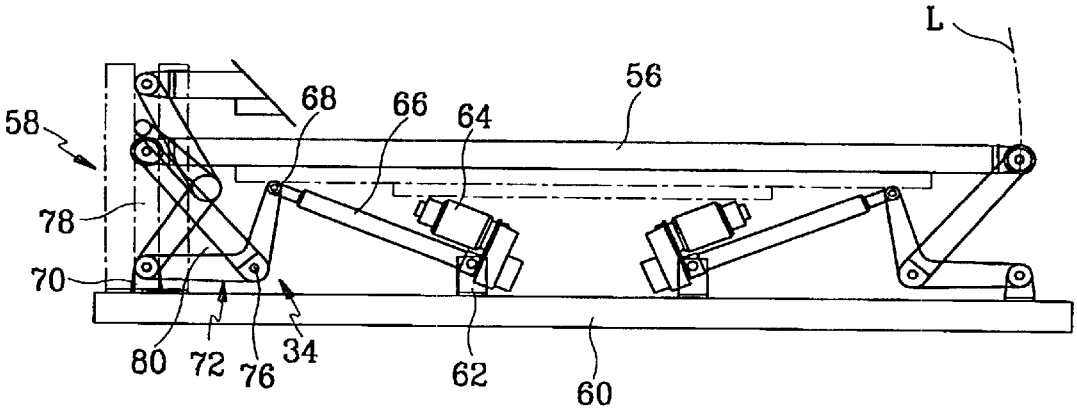
FIG. 6 is a side view of the free link system shown in FIG. 5.
Figure 7:
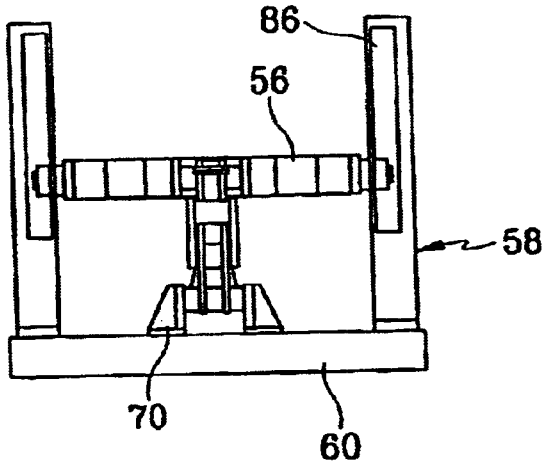
FIG. 7 is an end view of the free link system shown in FIG. 5.
Figure 8:
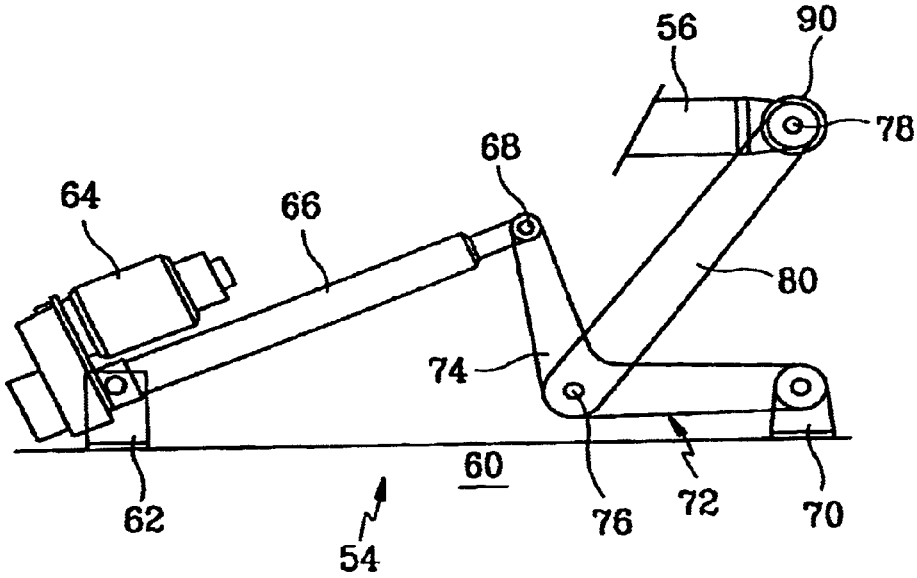
FIG. 8 is an enlarged schematic view of a drive assembly shown in FIG. 5.

FIG. 5 shows a plane view of free link system according to a preferred embodiment of the present invention; FIG. 6 shows a side view of the free link system shown in FIG. 5; FIG. 7 shows an end view of the free link system shown in FIG. 5; and FIG. 8 shows an enlarged schematic view of a drive assembly shown in FIG. 5. Reference numeral 52 refers to the free link system.

The free link system 52 includes a drive assembly 54, a main platform 56, and a guide frame 58. The drive assembly 54 is positioned along an imaginary longitudinal centerline of a rectangular base 60. The drive assembly 54 is comprised of two identical units provided on opposite ends of the base 60.

Each unit of the drive assembly 54 includes a hinge bracket 62 mounted to the base 60 along the imaginary longitudinal line; a piston link 66, a first end of which is rotatably mounted to the hinge bracket 62 and connected to a hydraulic power-generating cylinder 64; an angled link 72 having an angled portion 74 shaped at a predetermined angle, a first end mounted to a second hinge bracket 70 that is fixedly mounted to the base 60, and a second end connected to a second end of the piston link 66 through a hinge connector 68; and a support link 80 having a first end connected to the angled portion 74 of the angled link 72 through a first hinge pin 76 and a second end connected to the main platform 56 through a second hinge pin 78.

The main platform 56 is mounted on the base 60 and is raised by the drive assembly 54. A support bracket 82 is provided on each end of the main platform 56 to which the support links 80 of the drive assembly 54 are connected. Also, roller assemblies 84 are mounted to corners of one end of the main platform 56. Each roller assembly 84 includes a roller 90. The rollers 90 extend outwardly from the corners of the main platform 56 in a direction perpendicular to the imaginary longitudinal centerline of the main platform 56. The rollers 90 are inserted in the guide frame 58, which is provided extending vertically on one end of the base 60. That is, slide grooves 86 are formed at a predetermined length in the guide frame 58, and the rollers 90 are positioned within the slide grooves 86 to enable rectilinear motion therein by rotating about their axes.

In the free link system 52 described above, through the operation of the hydraulic power-generating cylinders 64 on each end of the system 52, the corresponding piston links 66 extend such that the angled links 72, which are connected to the piston links 66 through the hinge connectors 68, are pushed away from the base 60 by rotating about the second hinge brackets 70. As a result, the support links 80, which are connected to the angle links 72 through the first hinge pins 76, raise the main platform 56, which is mounted to the support brackets 82 through the second hinge pins 78. At this time, the rollers 90 of the roller assemblies 84 move along the slide grooves 86 of the guide frame 58 while the support link 80 pushes against the main platform 56 such that the main platform 56 is raised.

Since only one end of the main platform 56 is supported by the guide frame 58, the other end of the main platform 56 follows a trace L when raised on its own. As shown in FIG. 6, the trace 'L' curves slightly. Accordingly, the stable raising of the main platform 56 is realized.

Further, the main platform 56 may be precisely controlled such that the ends are raised to different desired heights depending on the various requirements of an assembly line.

In the free link system of the present invention described above, exceptional stability is realized in the system by the support provided and an ideal trace of motion when the main platform is raised and lowered. Accordingly, heavy and light objects may be simultaneously raised and lowered. Further, ends of the main platform can be precisely controlled to differing heights. As a result, objects placed on the main platform are stably maintained in their positions. Finally, application of the system for automatic conveying and in areas with limited space is possible, and through a simple structure, the overall cost of the system is minimized.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A free link system comprising:

a drive assembly mounted along an imaginary longitudinal center line of a rectangular base, the drive assembly including two identical units provided on opposing ends of the base;

a main platform that is raised and lowered by operation of the drive assembly; and a guide frame mounted to the base extending perpendicularly to the same, the guide frame being provided on one end of the base and acting to guide the movement of the main platform.

2. The system of claim 1 wherein each unit of the drive assembly comprises:

a hinge bracket mounted to the base along the imaginary longitudinal line;

a piston link, a first end of which is rotatably mounted to the hinge bracket and connected to a hydraulic power-generating cylinder;

an angled link having an angled portion shaped at a predetermined angle, a first end mounted to a second hinge bracket, which is fixedly mounted to the base, and a second end connected to a second end of the piston link through a hinge connector; and a support link having a first end connected to the angled portion of the angled link through a first hinge pin and a second end connected to the main platform through a second hinge pin.

3. The system of claim 2 wherein the main platform comprises:

a support bracket provided on each end of the main platform to which the support links of the drive assembly are connected; and roller assemblies mounted to corners of one end of the main platform, the roller assemblies sliding within the guide frame.

4. The system of claim 3 wherein slide grooves are formed at a predetermined length in the guide frame, and rollers of the roller assemblies are positioned within the slide grooves to enable rectilinear motion therein by rotating about their axes.

5. The system of claim 1 wherein a side of the main platform not supported by the guide frame follows a predetermined trace as the main platform is raised by the drive assembly.

* * * * *